US006564973B1

(12) United States Patent
Brown et al.

(10) Patent No.: US 6,564,973 B1
(45) Date of Patent: May 20, 2003

(54) CARTON FOR FOAM DISPENSING SYSTEM

(75) Inventors: Daniel P. Brown, Palos Park, IL (US); Michael C. Dean, Alpharetta, GA (US); Ross Wilson, Utica, IL (US); Gary Grunauer, Shorewood, IL (US); Gurp Ahluwalia, Palos Park, IL (US)

(73) Assignee: Flexible Products Company, Marietta, GA (US)

( * ) Notice: Subject to any disclaimer, the term of this patent is extended or adjusted under 35 U.S.C. 154(b) by 43 days.

(21) Appl. No.: 10/012,878

(22) Filed: Nov. 2, 2001

(51) Int. Cl.[7] ..... B67D 5/60

(52) U.S. Cl. ..... 222/145.1; 222/145.5; 222/146.5; 222/529; 229/122; 169/30

(58) Field of Search ..... 229/122; 222/145.1, 222/145.5, 145.6, 527, 529, 530; 169/30; 239/302, 303, 304

(56) References Cited

U.S. PATENT DOCUMENTS 3,499,582 A * 3/1970 Berney ..... 222/183
3,613,956 A * 10/1971 McCulloch ..... 222/135
3,633,795 A * 1/1972 Brooks ..... 222/134
3,744,709 A * 7/1973 Akkerman ..... 206/161
4,174,051 A * 11/1979 Edwards et al. ..... 222/105
4,815,631 A * 3/1989 Eeg et al. ..... 229/117.3
5,111,974 A * 5/1992 Parker ..... 222/399
5,195,661 A * 3/1993 Light ..... 222/105
5,344,051 A * 9/1994 Brown ..... 222/135
5,497,899 A * 3/1996 Wuerfel ..... 229/117.13
5,526,957 A * 6/1996 Brown et al. ..... 222/94
5,657,872 A * 8/1997 Leftwich et al. ..... 206/738
5,765,711 A * 6/1998 Johnson et al. ..... 220/62.2
5,924,599 A * 7/1999 Brown ..... 222/135
6,182,868 B1 * 2/2001 Hurray et al. ..... 222/145.1
6,283,221 B2 * 9/2001 Hurray et al. ..... 169/30

* cited by examiner

*Primary Examiner*—Ehud Gartenberg
*Assistant Examiner*—F. Nicolas
(74) *Attorney, Agent, or Firm*—Vedder Price Kaufman & Kammholz

(57) ABSTRACT

A carton for a foam dispensing system which includes supply containers, a dispenser and hoses for connecting each container to the dispenser. The carton includes first and second face panels which are interconnected by respective first and second side panels. Bottom panels extend from the first and second face panels to define a bottom of the carton. The cover panel extends from the first face panel to define a cover of the carton. A first flap which is defined in the cover panel, which, in an open position, is disposed at an angle to the cover panel. A handle is connected to the containers for carrying the carton and projects through the first access opening. A second flap is defined in the second face panel and the first reinforcing element. A third flap is defined in the second flap. The hoses extend from the containers, through hose paths associated with the second flap to the dispenser.

42 Claims, 6 Drawing Sheets

CARTON FOR FOAM DISPENSING SYSTEM

BACKGROUND OF THE INVENTION

The invention relates generally to an article packaging kit, and in particular to a carton for storing and transporting a polyurethane foam dispensing system for in-situ application of polyurethane foam.

There are numerous applications in which polyurethane foam is used in addition to its traditional use in the building trades as a source of insulation. Polyurethane foam has been used with increasing frequency as a sealant for sealing spaces between window and door frames and the like and as an adhesive for gluing flooring and roof tiles and the like. The polyurethane foam for such in-situ applications is typically supplied as a one-component froth foam or a two-component froth foam. A one-component foam means that the resin or prepolymer and activating agent for the foam is supplied in a single pressurized container and dispensed from the container through a dispenser or gun attached to the container. A two-component foam means that one component is supplied in one pressurized container, typically the "A" container (i.e., polymeric isocyanate, fluorocarbons, etc.) while the resin is supplied in a second pressurized container, typically the "B" container (i.e., polyols, epoxy, polyester, latex, catalyst, flame retardants, etc.). Typically, two-component kits use pressurized cylinders about 7½" in diameter containing 1–5 gallons (10–50 lbs.) which are connected by hoses to a dispenser.

There are advantages and disadvantages to one-component and two-component foams which are well known in the art. One of the advantages of the two-component system is its relatively fast-curing or catalyzing. Once the two compounds are mixed they rapidly react and cure. Accordingly, spraying on vertical surfaces does not run. This invention is discussed as it relates to two-component foams. However, it will be apparent that the teachings of this invention may be easily applied to systems using one-component foams.

A two-component kit includes two containers or cylinders, the dispenser and hoses connecting the cylinders to the dispenser. Typically, all of these items are packaged in a cardboard container, box or carton and the carton is then used to hand carry the items to the site where the foam is to be dispensed. Occasionally, the considerable length of hose may require that it be shipped separately. The carton typically has an opening for hand carrying the cylinders. Other regulations require the shipping carton to have sufficient strength and rigidity to permit stacking, dropping, etc.

A conventional prior art container for a two-component kit uses a cardboard, fold-out box with a separate cardboard tray. The tray fits over the valved ends of the cylinders to position the cylinders in place in the box during shipment and is integrated into the box such as by folding flaps fitting into tray slots at the box end adjacent the tray. On the top of the tray the hoses are placed in a coiled manner with the dispensing gun. To use, the operator opens the box end adjacent the tray and removes knock-out holes in the front face of the box. The hoses are then placed through the knock-out openings and tightened to the cylinder's valve fitting from above (discarding the protective shipping tubes) and the valves are opened. The cover is then folded back into the box to close the box and hoses extend out of the box. Because the box end adjacent the tray has to be opened and closed to open and close the valves for use of the dispensing gun, the box is usually provided with a strap or handle at the opposite box end which does not open. This results in the box being carried with the cylinders upsidedown. Disadvantages include excessive handling necessary to operate and an increased risk to the operator from having to manipulate the heavy carton.

Different packaging arrangements are used by different manufacturers. Many two-component kit packages use some form of tray with knock-out holes through which the hoses extend after the box is opened and the hoses attached to the cylinder's valved fitting. However, there is at least one two-component polyurethane foam box which utilizes cylinders equipped with "dip tubes" which extend through the outlet valve from the inside bottom of the cylinder. This allows the cylinders to be placed upright in the box instead of upside down. This carton does not use a tray and the hoses extend through the knock-out plugs in the side of the box. The carton is carried by a strap affixed to the top cover. The top cover is a flap which has to be opened and closed to gain access to the cylinder's valve after the hoses are connected to the cylinders. One disadvantage is the complicated setup.

One packaging arrangement has been designed for a particularly unique application for the mining industry trades in which the foam component cylinders are placed upright in the carton as shown in U.S. Pat. No. 6,182,868 (HURRAY et al.). This carton also does not use a tray and has the hoses extend out the side of the box through a knockout flap. The improvement in this carton is a top cover flap which extends from one of the front or rear panels for closing the carton and having first and second valve openings to permit the user to open and close the valves on the cylinders. The top cover flap has a partially filled center opening and a strap handle which connects the cylinders and extends through the center opening. This carton further includes a side flap which has a crown opening in registry with a valve opening in the top flap to allow access to a cylinder's valve without opening the carton. One disadvantage of this carton includes the complicated set up and operation must also be removed in order for the invention to operate as taught. Each side flap is folded, when the carton is assembled, to provide two-ply thickness between the top of the crown and the top flap. An outer disposable cover flap must also be removed in order for the invention to operate as taught.

This carton was specifically designed for use where the carton could be opened and assembled and positioned at its intended location in anticipation of some unknown future emergency use. This foam kit was principally intended for use in the mining industry where, in the event of fire in a shaft, the standard procedure is to extinguish the fire by sealing the shaft with a fire "door" and then pumping out air in the shaft sealed by the door in order to extinguish the fire.

Therefore, there is a need for an improved carton for use with a foam dispensing system that is more efficient to use and that is easy to set up.

BRIEF DESCRIPTION OF THE DRAWINGS

The features of the present invention which are believed to be novel are set forth with particularity in the appended claims. The invention, may be understood by reference to the following description taken in conjunction with the accompanying drawings in the several figures of which like reference numerals identify like elements:

DETAILED DESCRIPTION OF THE PREFERRED EMBODIMENTS OF THE INVENTION

The carton of the present invention is primarily for use in shipping, storing and using a two-component polyurethane foam dispensing system which includes two pressurized containers, a dispenser and a pair of hoses for connecting each container or to the gun. It will be apparent that the carton may be used in connection with a one-component foam dispensing system. The carton is preferably folded from a single blank into an integral structure. It will be recognized that other constructions may be used, for example, multiple pieces to form an integral structure. Further, the blank may be formed of any suitable material as required, such as cardboard, metal faced plastic fiberboard, laminated plastic, corrugated plastic or used papers.

The first and second face panels are interconnected at their upright edges with first and second side panels to form a rectangular opening when the blank is folded. Bottom panels extend from at least the first and second face panels to form a carton bottom when the blank is folded. The cover panel extends from the first face panel to form a carton top when the blank is folded. It will be apparent that the lines of weakening taught in the present invention are formed as stress risers which allow the blanks to be folded or separated from the blank to facilitate assembly and/or use. Other configurations of the lines of weakening are commonly referred to as score lines or perforation lines. A line of weakening is formed in the cover panel to define a first flap which is movable from a closed position to an open position. In the closed position the flap is coplanar with the cover panel, and in the open position the flap is disposed at an angle relative to the cover panel. The first access opening is revealed in the cover panel when the flap is moved to the open position. A handle is connected to the containers for carrying the carton and projects through the first access opening.

Second and third lines of weakening are formed in the second face panel and the first reinforcing element in a spaced apart relationship to define a second flap. A fourth of weakening is formed in the second flap to define a third flap. The hoses, which connect the cylinders and the dispenser, may be coiled with the gun and positioned between the second face panel and the cylinders when the system is shipped. It is within the teachings of the present invention that other hose positions and configuration, such as shipped separate from the carton, could be utilized with the present invention.

Figure 1:
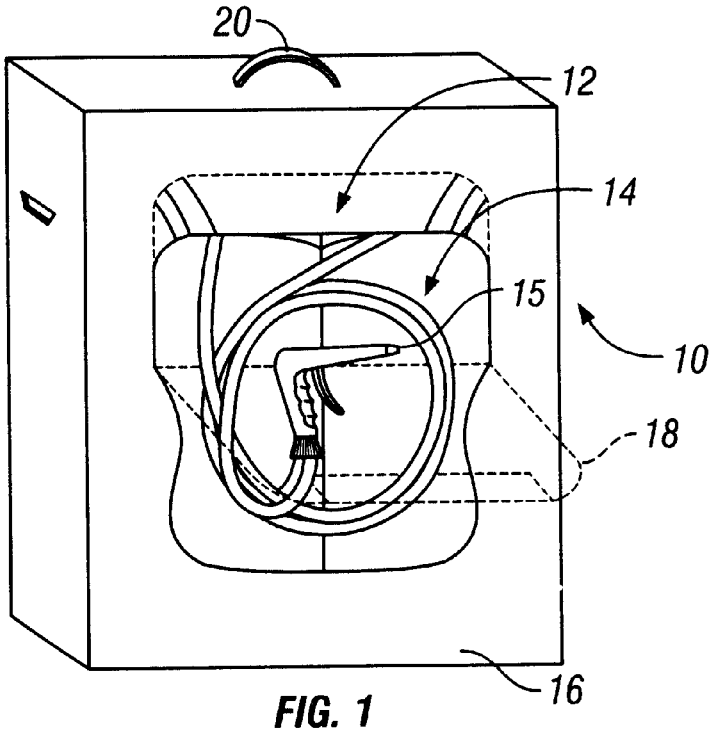
FIG. 1 (Prior Art)
FIG. 1 is a perspective view of a foam kit in the prior art.

FIG. 1 shows a perspective view of a prior art two-component portable polyurethane foam spray kit that is contained within a carton 10 which has its front flap shown in phantom for clarity. The kit includes two supply cylinders 12 where each cylinder has a valved fitting to which a hose 14 is connected to one end thereof. Each hose is connected at its opposite end to a dispensing gun 15 which is typically a multi-component mixing and metering dispenser molded from plastic. The front panel 16 has a reclosable, punch out front flap which is shown in phantom line 18 for illustration purposes. A strap handle 20 is connected to the cylinders 12 for carrying the carton 10.

Figure 2:
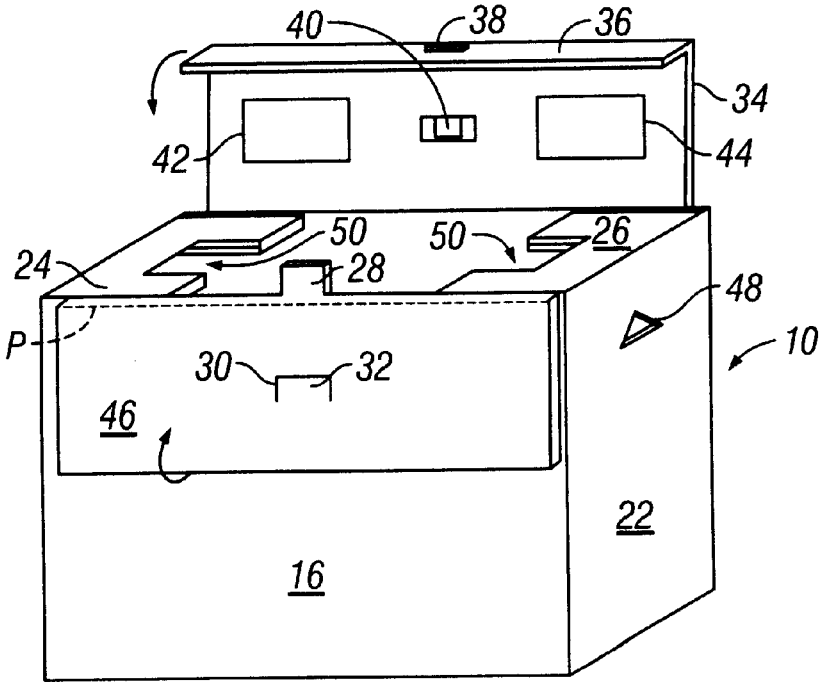
FIG. 2 (Prior Art)
FIG. 2 is a perspective view of a carton for a foam kit in the prior art.

FIG. 2 shows a perspective view of the prior art carton 10 without the foam spray kit. The carton 10 includes a front panel 16, a right-hand side panel 22, a top flap section 34, a removable secondary top flap 46, and a pair of side flap sections 24 and 26. A side die cut line 48 is formed in the right-hand side panel 22 to define a handle for the carton. The top flap section 34 further includes a foldable lip section 36, a tab opening 38, a top tab section 40 and a pair of rectangular shaped die cut lines or windows 42, 44 formed in the top flap section 34 in order to define openings by which the cylinder valves may be accessed when the top flap section 34 is in a closed position. The secondary removable top flap 46 further includes a cut line 30 formed therein to define a central tab section 32. The secondary top flap 46 may be removed from the carton 10 by tearing along the perforated line P. A locking tab section 28 is formed at the top of the front panel for engagement with the tab opening 38 formed in the top flap section 34 for retaining the top flap section 34 in the closed position. The side flap sections 24 and 26 each have openings 50 formed therein such that when the side flap sections 24 and 26 are folded as shown, the cylinder valves may be actuated when the top flap section 34 is closed. The side flap sections 24 and 26 are folded to provide at least twice thickness reinforcement to the top flap section 34. While the prior art carton structure may provide certain particular advantages for application within the mining industry trades, there is a need for an improved carton for a foam dispensing kit that costs less, is easier to set up and use, and provides novel features advantageous when used by the applicators.

Figure 3:
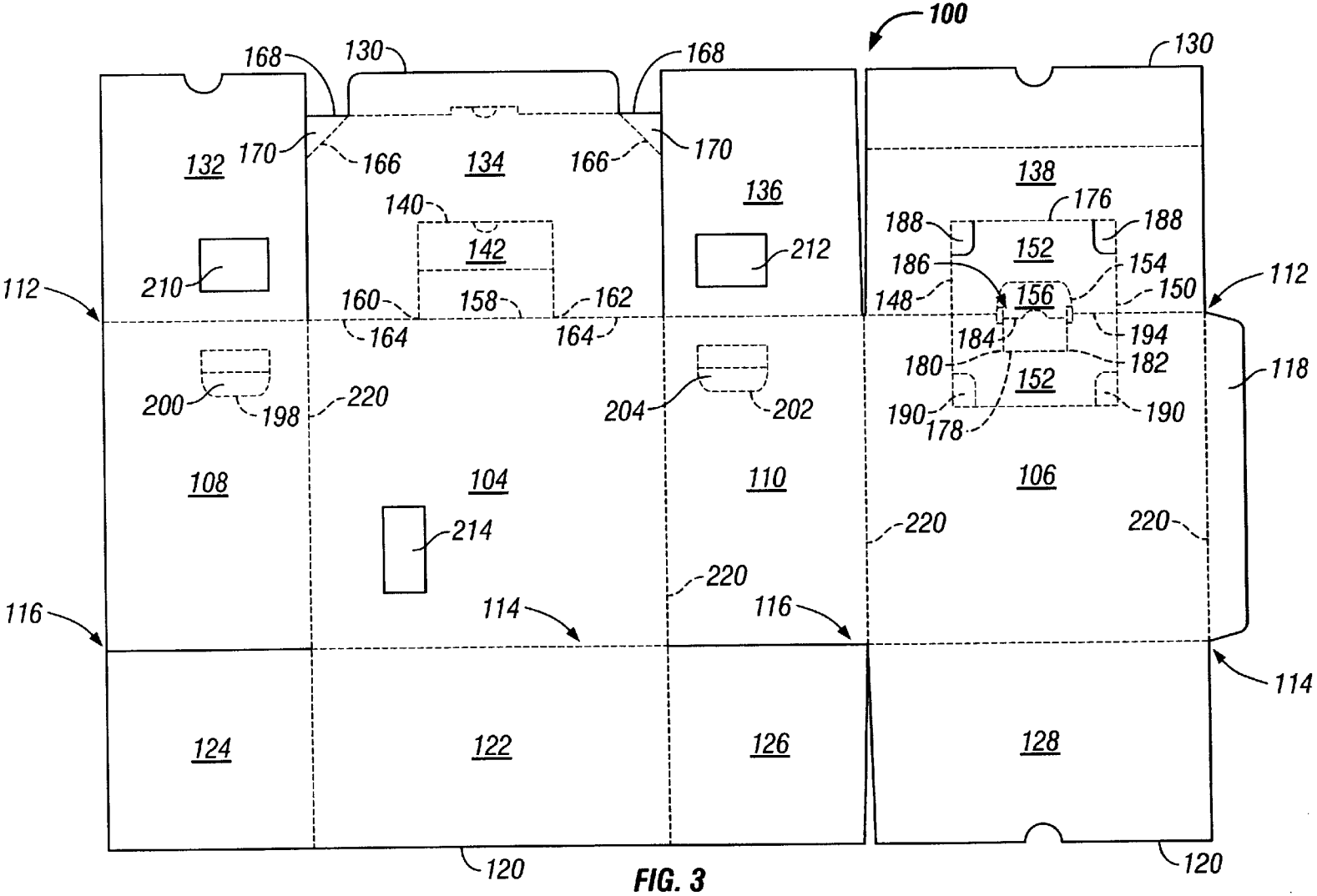
FIG. 3 is a plan view of the corrugated cardboard blank from which the carton of the present invention is formed.

FIGS. 3–7 illustrate the present invention with FIG. 3 showing a plan view of the blank 100 from which the carton 102 (FIGS. 4–7) of the present invention is formed. For consistency between the description and the drawings, solid lines are intended to mean cut lines, and dash-dot lines and dash--lines are intended to mean lines of weakening, i.e., stress risers which allow the blank to be folded (and left in place) or separated from the blank 100 to facilitate assembly and/or use. Occasionally, a line of weakening may be referred to as a fold line if that is the preferred configuration of such line. Further, the words "top", "bottom", "side", "face", and "vertical", when used herein are used relatively to orient one carton panel, face, section, element or component from another and are not necessarily used in an absolute directional sense.

Blank 100 has a first face panel 104, a second face panel 106, a first side panel 108, and a second side panel 110. Each panel 104, 106, 108, and 110, extends downwardly from a common top horizontal fold line 112. The first face panel 104 and the second face panel 106 extend upwardly from a common bottom horizontal fold line 114. The first side panel 108 and the second side panel 110 extend upwardly from a bottom cut line 116 which is coincident with the horizontal fold line 114. A glue flap 118 extends from the second face panel 106 such that the exterior surface of which is glued to the interior of the first-side panel 108 when the carton 102 is assembled.

Extending downward from the bottom horizontal fold line 114, in connection with the first face panel 104, to the bottom edge of blank 100 designated by reference numeral 120 is a first bottom panel 122 having a second reinforcing element 124 and a third reinforcing element 126 extending in opposition from the bottom panel 122 for reinforcing the carton 102 when the blank 100 is folded. Extending downward from the bottom horizontal fold line 114, in connection with second face panel 106, to the bottom edge 120 of blank 100 is a second bottom panel 128. The first and second bottom panels 122 and 128 form a carton bottom when the blank 100 is folded. Extending from top horizontal fold line 112 to the top edge of the blank 100 designated 130 is a fourth reinforcing element 132 extending from the first side panel 108, a cover panel 134 extending from the first face panel 104, a fifth reinforcing element 136 extending from the second side panel 110, and a first reinforcing element 138 extending from the second face panel 106.

Figure 7:
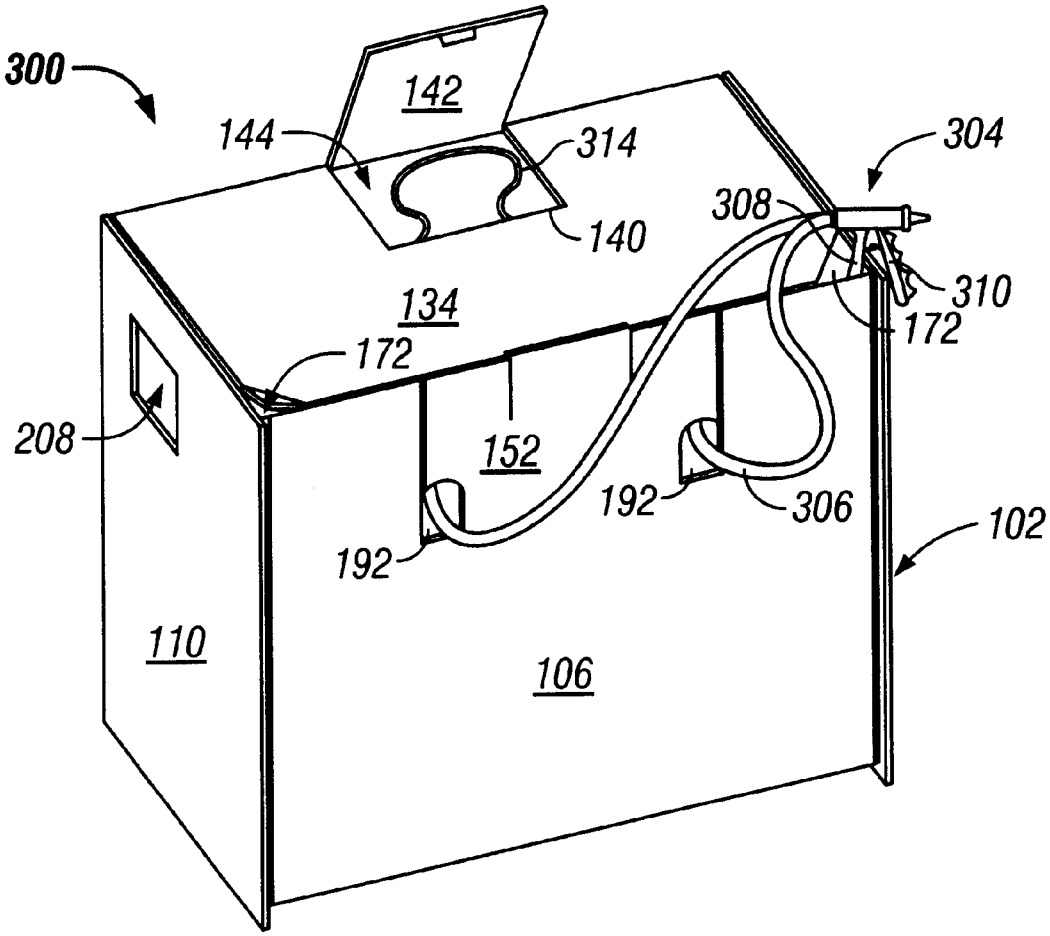

A first line of weakening 140 is formed in the cover panel 134 to define a first flap 142 which is movable from a first closed position where the first flap 142 is disposed substantially coplanar with the cover panel 134 to a second open position, where the first flap 142 is angularly disposed to the cover panel 134, as best shown in FIG. 7. A first access opening 144, as best shown in FIG. 7, for accessing the interior 146 of the carton 102-when the blank 100 is folded is defined in the cover panel 134 when the first flap 142 is moved from the first closed position to the second open position.

The first flap 142 is further defined by a first fold line 158 extending from a first end 160 of the first line of weakening to a second end 162 of the first line of weakening 140. The first fold line 158 is substantially coincident with a second fold line 164 and the top horizontal fold line 112, which are all disposed between the first face panel 104 and the cover panel 134. A fifth line of weakening adjacent each corner 168 of the cover panel 134 defines a fourth flap 170 which is movable from a first closed position disposed substantially coplanar with the cover panel 134 to a second open position angularly disposed to the cover panel 134 to reveal a dog-eared dispenser holder opening 172, as shown in FIG. 7. The fourth flap 170 is also detachable from the cover panel 134 along the fifth line of weakening 166 to form the dispenser holder opening 172.

The second line of weakening 148 and the third line of weakening 150 are jointly formed in the second face panel 106 and the first reinforcing element 138 in a spaced relationship to define the second flap 152. A fourth line of weakening 154 is formed in the second flap 152 to define a third flap 156. The second flap 152 is further defined by a third fold line 174 disposed on the second face panel 106 extending from the second line of weakening 148 to the third line of weakening 150, and a fourth fold line 176 disposed on the first reinforcing panel 138 extending from the second line of weakening 148 to the third line of weakening 150. The third flap 156 is further defined by a fifth fold line 178 disposed on the second flap 152 extending from a third end 180 of the fourth line of weakening 154 to a fourth end 182 of the fourth line of weakening 154. A sixth fold line 184 is formed on the third flap 156 defining an engagement element 186 of the third flap 156.

Precut openings 188 are formed in the second flap 152 adjacent each intersection of the fourth fold line 176 and the second and third lines of weakening 148 and 150 disposed on the first reinforcing panel 138. The precut openings 188 are formed in a spaced relationship such that one of the pair of first precut openings 188 is associated with the second line of weakening 148 and another of the pair of precut openings is associated with the third line of weakening 150.

Figure 6:
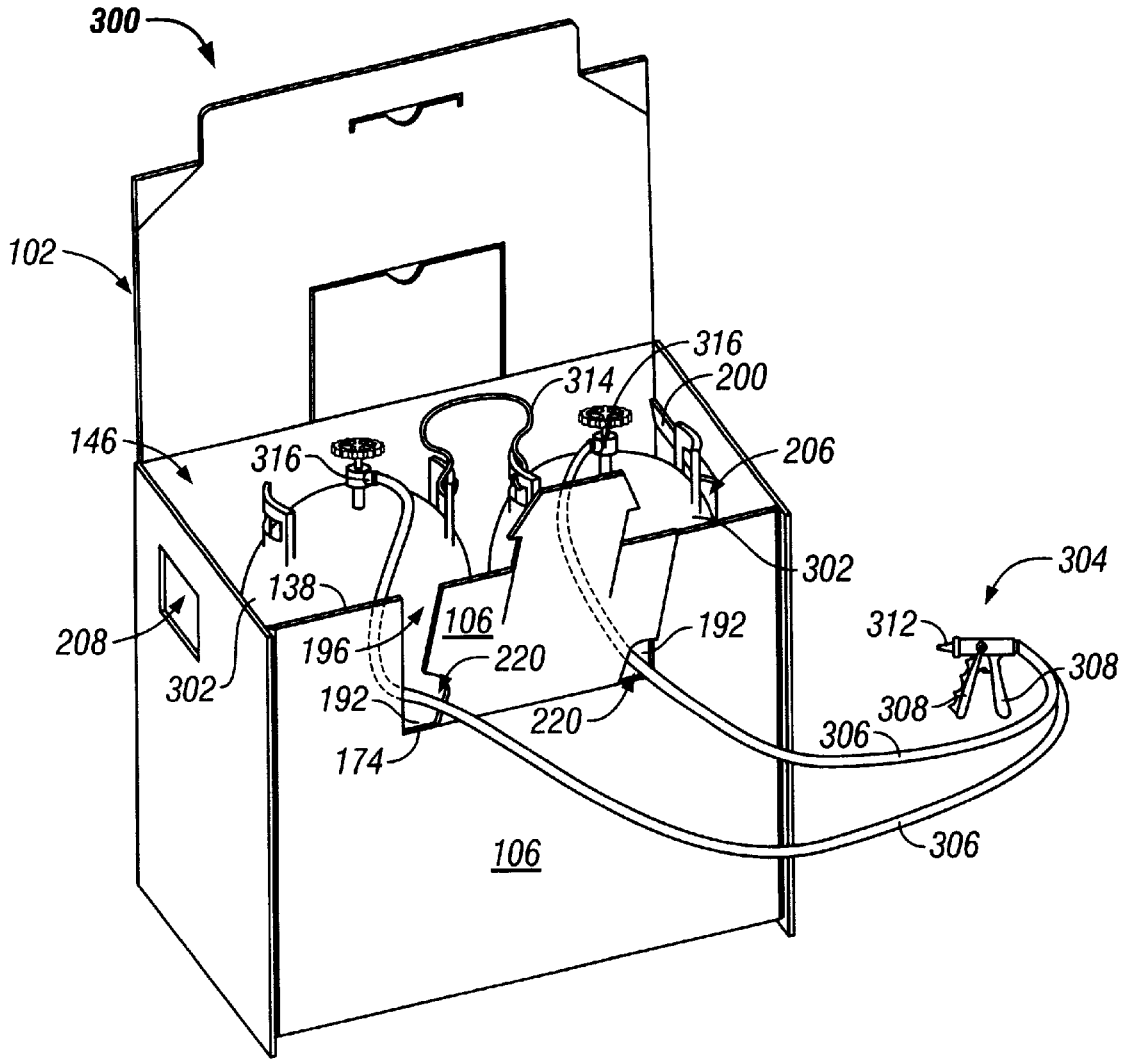
FIG. 6 is a perspective view of the foam kit of the present invention with the containers loaded and connected to the dispenser via hoses; and, FIG. 7 is a perspective view of the carton of the present invention ready-to-use with the dispenser at rest in an upright position in dispenser holder opening.

Knock-outs 190 are formed in the second flap 152 adjacent the third fold line 174 disposed on the second face panel 106 and defined by a portion of the second and third lines of weakening 148 and 150. The knock-outs 190 are removable from the cardboard blank 100 to form a knock-opening 192, as best shown in FIGS. 6 and 7, for capturing and maintaining the hoses at a particular orientation therein. The pair of first knock-out openings 192 are formed in a spaced relationship, such that one of the pair of first knock-out openings 192 is associated with and defined by the second line of weakening 148 and another of the pair of first knock-out openings 192 is associated with and defined by the third of weakening 150.

A seventh fold line 194 is formed on the second flap 152 substantially collinear with the sixth fold line 184 and the top horizontal fold line 112. When the blank 100 is folded the seventh fold line 194 generally bisects the second flaps 152 such that the third and fourth fold lines 174 and 176 are aligned and adjacent to permit the second flap 152 to move from a first closed position disposed substantially coplanar with the second face panel 106 and the first reinforcing element 138 to a second open position, as best shown in FIG. 6, angularly disposed to the second face panel 106 and the first reinforcing element 138. A second access opening 196 is revealed when the second flap 152 is moved about the adjacent third and fold lines 174 and 176.

Figure 5:
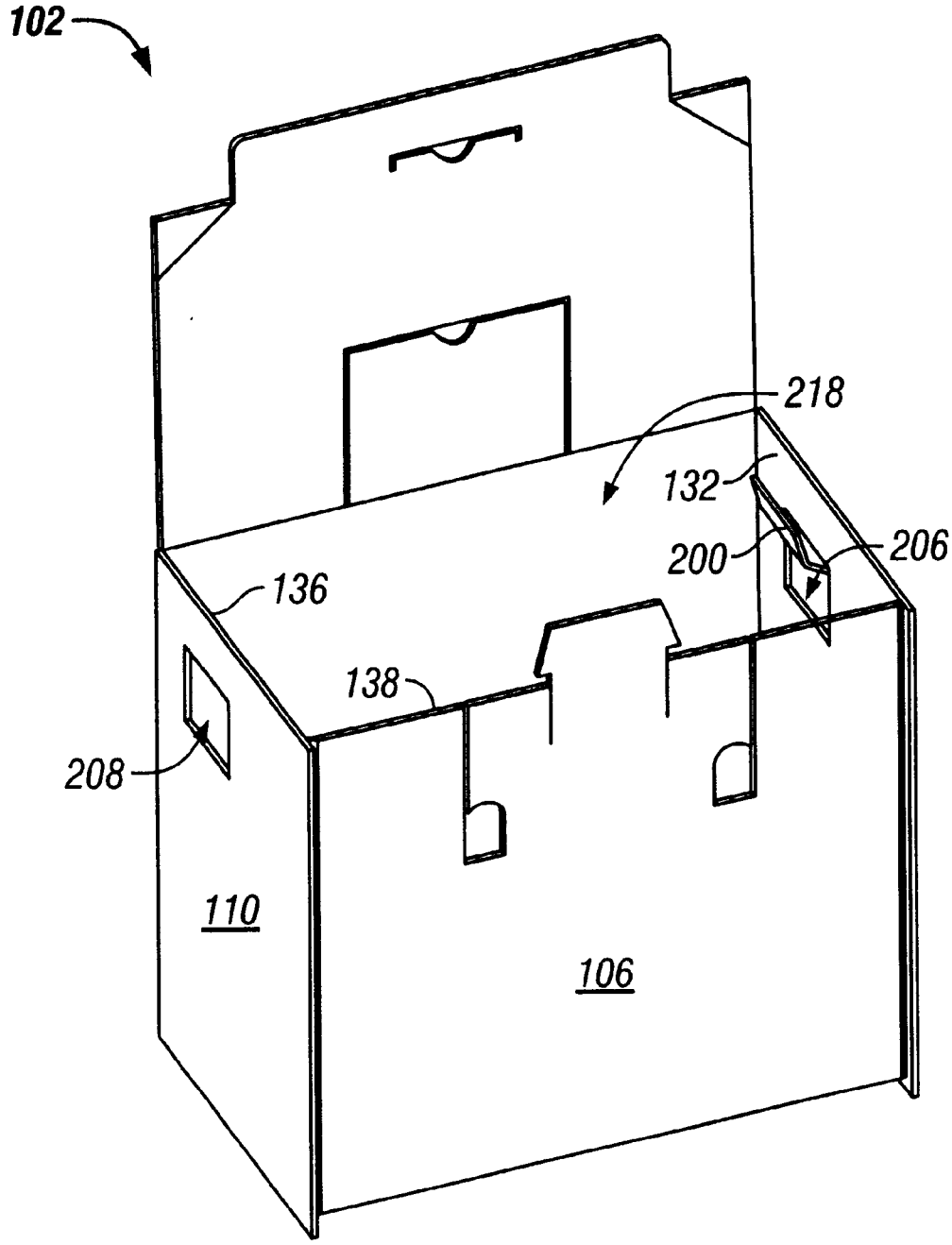
FIG. 5 is a perspective view of the carton of the present invention without the containers loaded.

A sixth line of weakening 198 is formed in the first side panel 108 to define a fifth flap 200 and a seventh line of weakening 202 is formed in the second side panel 110 define a sixth flap 204. The fifth and sixth flaps 200 and 204 are movable from a first closed position to a second open position, as best shown in FIGS. 5 and 6, extending into the rectangular opening 218 to reveal a first handle opening 206 in the first side panel 108 and a second handle opening 208 in the second side panel 110. The fourth reinforcing element 132, extending from the first side panel 108, includes a second precut opening 210, and the fifth reinforcing element 136, extending from the second side panel 110, includes a third precut opening 212. The fifth flap 200 projects through the second precut opening 210, and the sixth flap 204 projects through the third precut opening 212 when the blank 100 is folded.

A fourth precut opening 214 is formed in the first face panel 104 to reveal a thermometer adapted for attachment to one of the containers for indicating optimum operating temperature.

Figure 4:
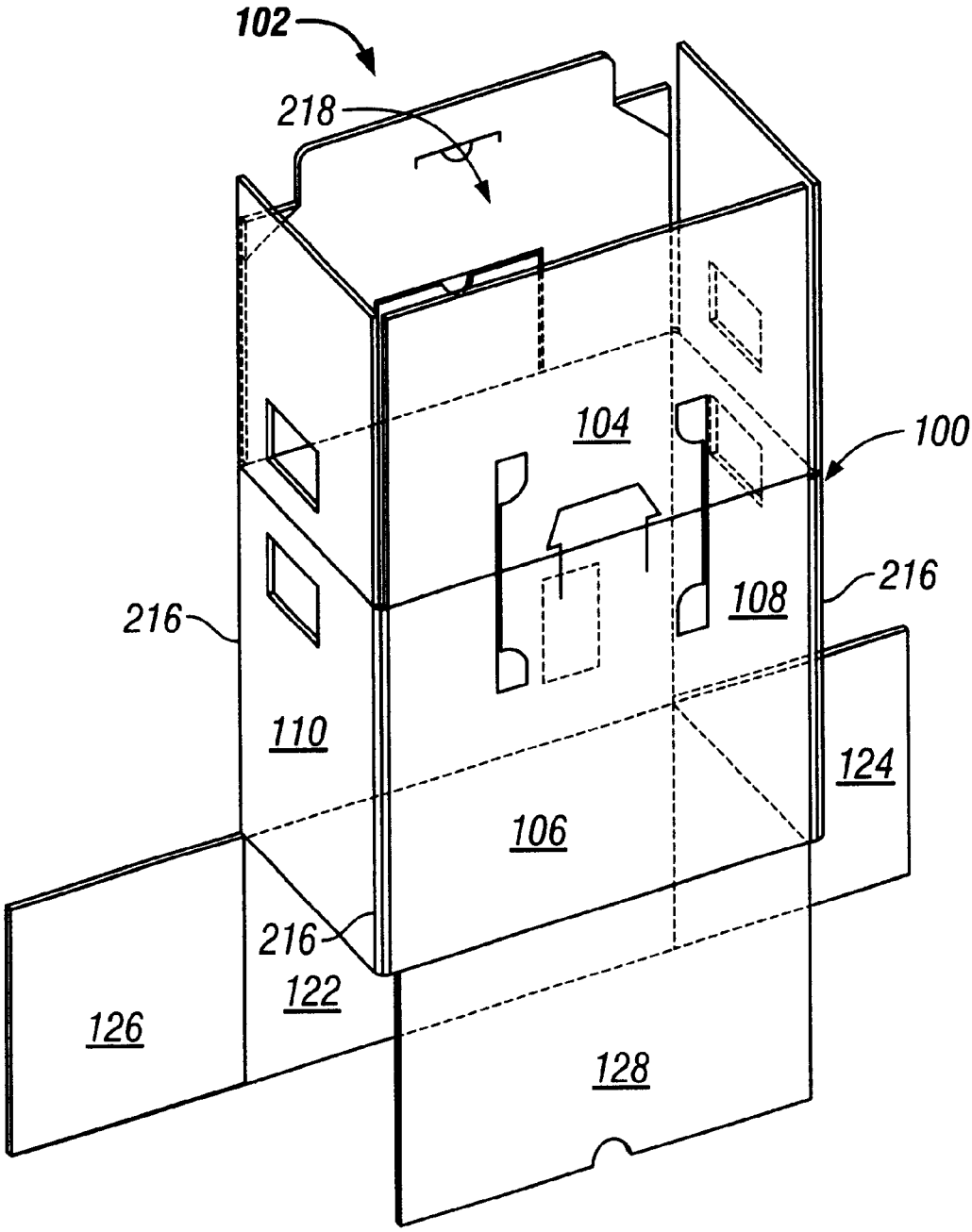
FIG. 4 is a perspective view of the corrugated cardboard blank of the present invention folded to form a rectangle opening.

FIG. 4 shows a perspective view of the corrugated cardboard blank of the present invention folded to form a rectangular opening. The first and second face panels 104 and 106 are interconnected at their upright extending ends 216 with the first and second side panels 108 and 110 to form the rectangular opening 218 when-the blank is folded. The carton 102 is assembled as shown by initially folding the blank 100 about vertical fold lines 220 and adhesively securing glue flap 118 to the inside surface of the first side panel 108. Alternatively, glue flap 118 could extend from the first side panel 108 and be secured to the second face panel 106. A rectangular enclosure now results having a rectangular opening 218.

The bottom of the carton 102 is formed by folding the second bottom panel 128 into the rectangular opening 218 so that the second bottom panel 128 is disposed flush against the interior surface of the second face panel 106. The second and third reinforcing elements 124 and 126 are then folded flush against the first bottom panel 122 such that when the first bottom panel 122 is folded perpendicular to the first face panel 104 in the direction of the rectangular opening 218, the second and third reinforcing elements 124 and 126 may be unfolded away from the first bottom panel 122 and in the direction of the first and second side panels 108 and 110.

The second and third reinforcing elements 124 and 126 are disposed flush against the interior surfaces of the first and second side panels 108 and 110. The second bottom panel 128 may then be moved away from the interior face of the second face panel 106 such that it is disposed flush against the first bottom panel 122. This construction provides a two-ply bottom thickness formed of the bottom panels 122 and 128. As a result of this construction, the carton bottom does not require any tape or adhesive to secure the bottom panels together in place. Alternatively, tape or adhesive may be used to provide increased strength.

FIG. 5 shows a perspective view of the carton 102 of the present invention before the cylinders are loaded. The carton 102 is further assembled to this stage by folding the fourth and fifth reinforcing elements 132 and 136 into the rectangular opening 218 such that the second and third reinforcing elements are retained between the fourth and fifth reinforcing elements 132 and 136 and the first and second side panels 108 and 110, respectively. The first reinforcing element 138 is then folded into the rectangular opening 218 such that it is disposed flush against the interior surface of the second face panel 106. The fifth flap 200 may be moved through the second precut opening in order to form the first handle opening 206. The sixth flap may be moved through the third precut opening in order to form the second handle opening 208. The remainder of the two-component foam kit may now be loaded for shipping, storage or use.

FIG. 6 shows a perspective view of the foam kit 300 of the present invention with the containers loaded and connected to the dispenser via hoses. The portable, two-component polyurethane foam kit 300 includes two pressurized containers 302, each containing a supply of a different reactive foam component. It will be apparent that it is within the teachings of the present invention that alternate supply container configurations could be utilized. For example, a third supply container for a nucleating or propellant agent may be used for a suitable purpose. A dispenser 304 for mixing the two foam components together to form a foam mixture and for selectively dispensing the mixed foam is connected to the containers by a pair of elongated hoses 306 which convey the foam components to the dispenser 304 at a location remote from the containers. The dispenser 304 has a handle 308, an actuation lever 310 and a nozzle 312. A rigid handle 314 is movably connected to the containers such that it may be moved to project through the first access opening 144 for carrying the carton. It is within the teachings of the present invention that other handle configurations, including flexible handles, could be utilized for carrying the carton. The hoses 306 are connected to the containers at the control valves 316 and the dispenser during assembly and then are coiled for installation within the rectangular opening 218 of the carton 102.

When ready for use, the hoses 306 and dispenser 304 are removed from the carton 102. The second flap 152 is then moved to the second open position angularly disposed to the second face panel 106 and the first reinforcing element 138 to reveal the second access opening 195 by which the interior of the carton 102 is accessible. The knock-outs formed in the second flap 152 adjacent the third fold line 174 disposed on the second face panel 106 are detachable from the second flap 152 to form the knock-out openings 192. The knock-out openings 192 and the first precut openings are in registry with one another when the carton 102 is assembled. In order to move the second flap 152 from the first closed position to the second open position, as shown in FIG. 6, the second flap 152 is detached along the second and third lines of weakening 148 and 150. The second flap 152 is now movable about the third and fourth fold lines 174 and 176. When the second flap 152 is moved to the second open position, the hoses 306 are inserted through the second access opening 196 into the hose paths 220, which are defined when the knock-out openings 192 and first precut openings 188 are in registry. The hoses 306 disposed within the hose paths 220 permit the second flap 152 to be returned to the first closed position for storage or use. The hoses 306 are captured and maintained within the hose paths 220 at an angular orientation with respect to the second face panel 106 so as to keep the hoses 306 exiting the carton 102 generally transverse to the second face panel 106 so that the hoses 306 will not interfere with the stability of the carton 102 during use of the kit 300. The hose paths 220, and therefore the first knock-out openings 192 and the first precut openings 188, are disposed at the same level in order to prevent twisting of the hoses 306, and are preferably disposed within approximately two inches of the container valve 316 or connection point on the container.

FIG. 7 shows a perspective view of the carton of the present invention ready-to-use with the dispenser 304 stored in an upright position in a dispenser holder opening 172. The first flap 142 is partially detachable from the cover panel 134 along the first line of weakening 140 such that it is movable to a second open position as shown. The first access opening 144 is revealed in the cover panel 134 when the first flap 142 is moved to the second open position. The handle 314 is movable to an upright position to project the first access opening 144 when the first flap 142 is in the second open position in order to transport the foam kit 300. The dispenser handle 308 when not in use may be inserted into the dispenser holder opening 172 which is revealed when the fourth flap 170 is moved to the second open position or detached from the cover panel 134. The dispenser holder opening 172, whether dog-eared or open, receives and maintains the dispenser 304 in an upright position.

Thus, the present invention fulfills the need in the prior art for providing a simple, cost effective carton which can be used, in particular with foam dispensing systems.

The invention is not limited to the particular details of the apparatus depicted and other modifications and applications may be contemplated. For example, the knock-out openings may be formed as precut openings. Also, the reinforcing elements formed with the first bottom panel may extend from the first and second side panels. Certain other changes may be made in the above-described apparatus without departing from the true spirit and scope of the invention here involved. It is intended, therefore, that the subject matter of the above depiction shall be interpreted as illustrative and not in a limiting sense.

What is claimed is:

1. A carton for a foam dispensing system which includes at least one foam component supply container, a dispenser and at least one hose for interconnecting the dispenser to each at least one supply container, the carton being formed from a blank, said carton comprising:

first and second face panels interconnected by respective first and second side panels to form a rectangular opening when the blank is folded;

bottom panels depending from at least the first and second face panels defining a bottom of said carton;

a cover panel extending from the first face panel defining a cover of said carton;

a first line of weakening defining a first flap in the cover panel which is movable from a first closed position disposed substantially coplanar with the cover panel to a second open position angularly disposed to the cover panel;

a first access opening for accessing an interior of the carton defined in the cover panel by the first line of weakening and revealed when the first flap is moved from the first closed position to the second open position;

second and third lines of weakening formed in the second face panel and a first reinforcing element in a spaced relationship to define a second flap;

a fourth line of weakening formed in the second flap to define a third flap; and a handle movably connected to the containers and projecting through the first access opening for carrying the carton.

2. The carton of claim 1, wherein at least one hose is connected to each at least one container and the dispenser and is coiled with the dispenser in the carton when the kit is shipped.

3. The carton of claim 1, wherein the first flap is further defined by a first fold line extending from a first end of the first line of weakening to a second end of the first line of weakening.

4. The carton of claim 3, wherein the first fold line is substantially coincident with a second fold line disposed between the first face panel and the cover panel.

5. The carton of claim 1, further including at least one fifth line of weakening formed adjacent a comer in the cover panel to define at least one fourth flap which is movable from a first closed position to a second open position to reveal a dispenser holder opening.

6. The carton of claim 5, wherein the fourth flap is detachable from the cover panel along the fifth line of weakening to define the dispenser holder opening.

7. The carton of claim 1, wherein the second flap is further defined by a third fold line disposed on the second face panel extending from the second line of weakening to the third line of weakening and a fourth fold line disposed on the first reinforcing panel extending from the second line of weakening to the third line of weakening.

8. The carton of claim 1, wherein the third flap is further defined by a fifth fold line disposed on the second flap and extending from a third end of the fourth line of weakening to a fourth end of the fourth line of weakening.

9. The carton of claim 8, wherein a sixth fold line is formed on the third flap defining an engagement element of the third flap.

10. The carton of claim 1, further including at least one precut opening formed in the second flap, adjacent a fourth fold line disposed on the first reinforcing panel.

11. The carton of claim 10, wherein a pair of the first precut openings are formed in spaced relationship such that one of the pair of first precut openings is associated with the second line of weakening and another of the pair of first precut openings is associated with the third line of weakening.

12. The carton of claim 1, further including at least one first knock-out formed in the second flap adjacent a third fold line disposed on the second face panel which is removable to form a knock-out opening for capturing and retaining the at least one hose therein.

13. The carton of claim 12, wherein a pair of the first knock-out openings are formed in spaced relationship, such that one of the pair of first knock-out openings is associated with and defined by the second line of weakening and another of the pair of first knock-out openings is associated with and defined by the third line of weakening.

14. The carton of claim 7, wherein a seventh fold line is disposed on the second tab substantially collinear with a sixth fold line such that when the blank is folded the third and fourth fold lines are adjacent so that the second flap is moveable from a first closed position disposed substantially coplanar with the second face panel and the first reinforcing element to a second open position angularly disposed to the second face panel and the first reinforcing element to reveal a second access opening when moved about the third and fourth fold lines.

15. The carton of claim 14, wherein each at least one first precut opening formed in the second flap on the first reinforcing element is in registry with each at least one first knock-out opening formed in the second flap on the second face panel cooperatively defining hose paths which capture and maintain each at least one hose when the second flap is disposed in the first closed position.

16. The carton of claim 15, wherein each at least one hose projects through the hose path at an angular orientation with respect to the second face panel.

17. The carton of claim 1, further including second and third reinforcing elements flanking at least one of the bottom panels for reinforcing the carton when the blank is folded.

18. The carton of claim 1, further including a sixth line of weakening formed in the first side panel to define a fifth flap and a seventh line of weakening formed in the second side panel to define a sixth flap, such that the fifth and sixth flaps are moveable from a first closed position to a second open position extending into the rectangular opening to reveal a first handle opening in the first side panel and a second handle opening in the second side panel.

19. The carton of claim 18, further including a fourth reinforcing element extending from the first side panel including a second precut opening and a fifth reinforcing element extending from the second side panel including a third precut opening.

20. The carton of claim 19, wherein the fifth flap projects through the second precut opening defining a first handle opening, and the sixth flap projects through the third precut opening defining a second handle opening when the blank is folded.

21. The carton of claim 1, wherein the handle is rigid.

22. A kit of parts including at least one foam component supply container, a dispenser for mixing the foam and for selectively dispensing the foam, at least one elongated hose for connecting the dispenser to each at least one foam component supply container for conveying the foam to the dispenser at a location remote from the at least one foam component supply container, and a carton for storing and transporting the at least one foam component supply container, the at least one hose and the dispenser, said carton comprising:

first and second face panels interconnected by respective first and second side panels to form a rectangular opening when the blank is folded;

bottom panels depending from at least the first and second face panels defining a bottom of said carton;

a cover panel extending from the first face panel defining a cover of said carton;

a first line of weakening defining a first flap in said cover panel which is movable from a first closed position disposed substantially coplanar with the cover panel to a second open position angularly disposed to the cover panel;

a first access opening for accessing the interior of the carton defined in the cover panel by the first line of weakening and revealed in the cover panel when the first flap is moved from the first closed position to the second open position;

second and third lines of weakening formed in the second face panel and a first reinforcing element in a spaced relationship to define a second flap;

a third fold line disposed on the second face panel extending from the second line of weakening to the third line of weakening;

a fourth fold line disposed on the first reinforcing panel extending from the second line of weakening to the third line of weakening; and, a seventh fold line disposed on the second flap such that when the blank is folded about the seventh fold line the third and fourth fold lines are disposed adjacent one another so that the second flap is movable from a first closed position disposed substantially coplanar with the second face panel and the first reinforcing element to a second open position angularly disposed to the second face panel and the first reinforcing element to reveal a second access opening by which the interior of the carton is accessible.

23. The kit of claim 22, further including at least one first knock-out formed in the second flap adjacent the third fold line disposed on the second face panel which is detachable to form at least one knock-out opening within the second flap to capture and retain the at least one hose therein.

24. The kit of claim 23, wherein a pair of the first knock-out openings are formed in spaced relationship, such that one of the pair of first knock-out openings is associated with and defined by the second line of weakening and another of the pair of first knock-out openings is associated with and defined by the third line of weakening, such that each first knock-out opening captures and retains one of the at least one hose therein.

25. The kit of claim 23, wherein each at least one first knock-out opening is disposed at the same level in order to prevent twisting of the hoses.

26. The kit of claim 25, wherein each at least one first knock-out opening is disposed within approximately two inches of connection to the containers.

27. The kit of claim 22, further including at least one fifth line of weakening formed adjacent a corner in the cover panel to define at least one fourth flap.

28. The kit of claim 27, wherein the fourth flap is movable from a first closed position to a second open position revealing a dispenser holder for receiving and maintaining the dispenser in an upright position.

29. The kit of claim 27, wherein the fourth flap is detachable along the fifth line of weakening to define a dispenser holder opening for receiving and maintaining the dispenser in an upright position.

30. The kit of claim 22, wherein the at least one foam component supply containers includes a pair of supply containers of different reactive foam components where one supply container contains a polymer and the other supply container contains a reactive agent.

31. The kit of claim 22, wherein the at least one foam component supply containers includes a propellant.

32. A portable foam dispensing kit comprising:

at least one foam supply container;

a dispenser for mixing the foam and dispensing the foam, the dispenser including a handle and an actuation lever projecting from the dispenser and spaced apart from each other;

at least one elongated hose for connecting the dispenser to each at least one foam supply container in order to convey the foam to the dispenser at a location remote from the at least one foam supply container, a carton for storing and transporting the at least one foam supply container, dispenser and at least one hose as a single unit, said carton including first and second face panels interconnected by respective first and second side panels to define a hollow carton with four distinct sides;

bottom panels depending from at least the first and second face panels defining a bottom of said carton;

a cover panel extending from the first face panel defining a cover of said carton;

a first line of weakening disposed in the cover panel defining a first flap which is movable from a first closed position disposed substantially coplanar with the cover panel to a second open position angularly disposed to the cover panel, said first flap defining a first access opening in the cover panel when the first flap is moved to the second open position; and, at least one additional line of weakening disposed on the cover panel adjacent a corner thereof, that defines at least one flap that is foldable or detachable from the cover in a manner to define a dispenser opening for receiving either of the dispenser handle or actuation lever and maintaining the dispenser in an upright position.

33. The kit of claim 32, wherein the first fold line is substantially coincident with a second fold line disposed between the first face panel and the cover panel.

34. The kit of claim 32, further including second and third reinforcing elements flanking at least one of the bottom panels for reinforcing the carton when the blank is folded.

35. The kit of claim 32, further including a sixth line of weakening formed in the first side panel to define a fifth flap and a seventh line of weakening formed in the second side panel to define a sixth flap, such that the fifth and sixth flaps are moveable from a first closed position to a second open position extending into the rectangular opening to reveal a first handle opening in the first side panel and a second handle opening in the second side panel.

36. The kit of claim 35, further including a fourth reinforcing element extending from the first side panel including a second precut opening and a fifth reinforcing panel extending from the second side panel including a third precut opening.

37. The kit of claim 36, wherein the fifth flap projects through the second precut opening, and the sixth flap projects through the third precut opening when the blank is folded.

38. The kit of claim 32, wherein the fourth flap is detachable along the fifth line of weakening to define a dispenser holder opening for receiving and maintaining the dispenser in an upright position.

39. The kit of claim 32, wherein the at least one foam component supply containers includes a pair of supply containers of different reactive foam components where one supply container contains a polymer and the other supply container contains a reactive agent.

40. A carton for a foam dispensing system which includes at least one foam component supply container, a dispenser and at least one hose for interconnecting the dispenser to each at least one supply container, the carton being formed from a blank, said carton comprising:

first and second face panels interconnected by respective first and second side panels to define a hollow carton with four distinct sides;

bottom panels depending from at least the first and second face panels defining a bottom of said carton;

a cover panel extending from the first face panel defining a cover of said carton;

a pair of lines of weakening formed in the second face panel and a first reinforcing element in a spaced relationship to define a flap;

a third fold line disposed on the second face panel extending between the spaced lines of weakening;

a fourth fold line disposed on the first reinforcing element extending between the spaced lines of weakening;

a pair of first knock-out openings formed in a spaced relationship in the second flap on the second face panel adjacent the third fold line, such that one of the pair of first knock-out openings is associated with and defined by one of the lines of weakening and another of the pair of first knock-out openings is associated and defined by the other line of weakening;

a pair of first pre-cut openings formed in spaced relationship in the second flap on the first reinforcing element adjacent the fourth fold line, such that one of the pair of first pre-cut openings is associated with one of the lines of weakening and another of the pair of first pre-cut openings is associated with the other line of weakening such that the pair of first pre-cut openings are in registry with the pair of first knock-out openings for cooperatively defining hose paths which capture and maintain the hoses in a particular orientation when the second flap is disposed in a first closed position.

41. The carton of claim 40, wherein the pair of first knock-out openings and the first pre-cut openings are all disposed at the same level in order to prevent twisting of the hoses.

42. The carton of claim 41, wherein the pair of first knock-out openings and the first pre-cut openings are disposed within approximately two inches of connection points on the containers.

* * * * *